US006233747B1

(12) United States Patent
Barker

(10) Patent No.: US 6,233,747 B1
(45) **Date of Patent: *May 22, 2001**

(54) DETACHABLE TRANSFER POCKET SYSTEM AND METHOD

(76) Inventor: Lydia M. Barker, 1055 Phoenix Ave., Schenectady, NY (US) 12308

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/203,433

(22) Filed: Dec. 1, 1998

(51) Int. Cl.[7] ..... A41D 27/20
(52) U.S. Cl. ..... 2/247; 2/251
(58) Field of Search ..... 2/247, 251, 252

(56) References Cited

U.S. PATENT DOCUMENTS

| | | | | |
|---|---|---|---|---|
| D. 243,291 | | 2/1977 | Mechaly et al. | D2/742 X |
| D. 281,636 | * | 12/1985 | Cressy-Renoma . | |
| 2,686,313 | * | 8/1954 | Seidler . | |
| 2,825,068 | * | 3/1958 | Montgomery . | |
| 3,374,508 | * | 3/1968 | Slimovitz | 24/6 |
| 3,438,062 | * | 4/1969 | Dobell . | |
| 4,156,293 | * | 5/1979 | Off | 2/247 |
| 4,218,781 | * | 8/1980 | Lieberman | 2/247 |
| 4,266,300 | * | 5/1981 | Partridge | 2/247 |
| 4,389,801 | * | 6/1983 | Sharrock et al. | 40/775 |
| 4,446,573 | * | 5/1984 | Green | 2/252 |
| 4,485,496 | * | 12/1984 | Shanks, Jr. | 2/247 |
| 4,507,882 | * | 4/1985 | Harrell | 36/136 |
| 4,602,390 | * | 7/1986 | Morera et al. | 2/251 |
| 4,625,340 | * | 12/1986 | Hernandez | 2/247 |
| 4,651,355 | * | 3/1987 | White | 2/247 |
| 5,054,127 | * | 10/1991 | Zevchak | 2/247 |
| 5,063,614 | * | 11/1991 | McSheffery | 2/94 |
| 5,464,235 | | 11/1995 | Goldman | 280/11.2 |
| 5,465,887 | | 11/1995 | Hudson | 224/651 |
| 5,496,205 | | 3/1996 | Lee | 450/89 |
| 5,497,733 | | 3/1996 | Hull et al. | 119/793 |
| 5,553,322 | | 9/1996 | Cebo-Johnson | 2/69 |
| 5,570,470 | | 11/1996 | Miller | 2/22 |
| 5,593,073 | | 1/1997 | Finnegan | 224/183 |
| 5,598,923 | | 2/1997 | Owens | 206/370 |
| 5,617,587 | * | 4/1997 | Marchbanks | 2/247 |
| 5,651,143 | | 7/1997 | Zehrung | 2/338 |
| 5,652,961 | | 8/1997 | Knight-Yurt | 2/114 |
| 5,664,360 | | 9/1997 | Conway | 42/90 |
| 5,664,673 | | 9/1997 | Perry | 206/371 |
| 5,713,077 | | 2/1998 | Humbrecht | 2/173 |
| 5,720,046 | * | 2/1998 | Lopez et al. | 2/159 |
| 5,735,004 | | 4/1998 | Wooten et al. | 5/502 |
| 5,946,732 | * | 9/1999 | Richards . | |
| 6,035,449 | * | 3/2000 | Galler et al. | 2/249 |
| 6,108,816 | * | 8/2000 | Bradley | 2/102 |

* cited by examiner

*Primary Examiner*—John J. Calvert
*Assistant Examiner*—Katherine Moran
(74) *Attorney, Agent, or Firm*—Schmeiser, Olsen & Watts

(57) ABSTRACT

A free-standing, removable transfer pocket system enables transfer pockets to be attached and detached at will to and from garments such as clothing and other surfaces, using Velcro®.

6 Claims, 9 Drawing Sheets

DETACHABLE TRANSFER POCKET SYSTEM AND METHOD

FIELD OF THE INVENTION

This invention relates generally to pockets, particularly regarding pockets attached to garments and the removal and transfer thereof.

BACKGROUND OF THE INVENTION

The traditional standard pocket appearing on casual wear and dress attire has limited function for the consumer due to its permanence. Because these pockets are fixed structures, they very often cause a tight pulling sensation when full and over time tear and fray, ending further usage of the pocket or risking the loss of change, keys, etc. Unless patched or sewn, torn or frayed pockets also negatively affect the overall appearance of the garment they are attached to.

The extensive manufacture of permanent pockets on various clothing is an indicator of their popularity. Pockets are conventionally used as a storage place for one's valuables and non-valuables, a place to carry items to one's destination while freeing one's hands, and when empty, a place to position or warm one's hands, if desired, with little style.

These traditional beliefs relative to viewing pockets are suggest a limited prior art perspective. For example, U.S. Pat. No. 243291 typifies the basic use of fixed, or sewn on packets as known in the art.

U.S. Pat. No. 5,652,961 discloses a detachable hospital scrub top including a neck strap at the neck for a stethoscope, detachable sleeves, and a two pocket pouch at the waist area having two separate flaps secured by Velcro™ (hook and loop fasteners), and an area behind the pocket with a third wide pocket, as well as a double pocket on the sleeve for pens, pencils, etc. This pocket pouch is designed strictly to benefit those working in an operating room with no other purpose. It does not have unique ornamentation, so usage is of a limited nature.

U.S. Pat. No. 5,713,077 is a ski jacket and hood with interior pocket that uses the pocket to store a face mask when not in use. The lower edge of the face mask uses Velcro™ (hook and loop fasteners) strips to hold the mask into a lowered position when in use. This pocket is intended for storage and is used within a specific area to assist a skier in maintaining warmth. Fashion is certainly not a consideration when using a face mask.

U.S. Pat. No. 5,664,673 is a storage band for a video monitor using Velcro™ (hook and loop fastener) material. The side plates of this storage device have pockets for storing pencils, markers and small floppy disks. The front plate of this storage device has a pocket for holding objects for persons using video monitor. Again these pockets have restricted usage.

U.S. Pat. No. 5,735,004 is a water resistant baby blanket assembly with a pocket for protection of the head of the infant from adverse weather conditions. Velcro™ (hook and loop fasteners) is connected to the edges of the blanket for connection of the blanket to baby carriers and for connection to another of the strips connected to the blanket assembly. Thus Velcro™ (hook and loop fasteners) usage in all of the heretofore mentioned patents has not other creative use, only practical, lacking spontaneity, with little potential other than to hold or fasten one's pocket.

OBJECTS OF THE INVENTION

It would therefore be desirable to significantly increase an apparel item's utility with minimal effort.

It would further be desirable to have a removable pocket that can be used and changed more easily than a traditional sewn on (permanent) pocket.

It would further be desirable to have a pocket that alleviates the pulling sensation which accompanies a traditional filled pocket.

It would further be desirable to have a pocket lending itself to multiple uses.

SUMMARY OF THE INVENTION

A free-standing, removable transfer pocket system enables transfer pockets to be attached and detached at will to and from garments such as clothing and other surfaces.

BRIEF DESCRIPTION OF THE DRAWINGS

The features of the invention believed to be novel are set forth in the appended claims. The invention, however, together with further objects and advantages thereof, may be best understood by reference to the following description taken in conjunction with the accompanying drawing(s) in which:

DETAILED DESCRIPTION OF THE PREFERRED EMBODIMENT OF THE INVENTION

Figure 1A:
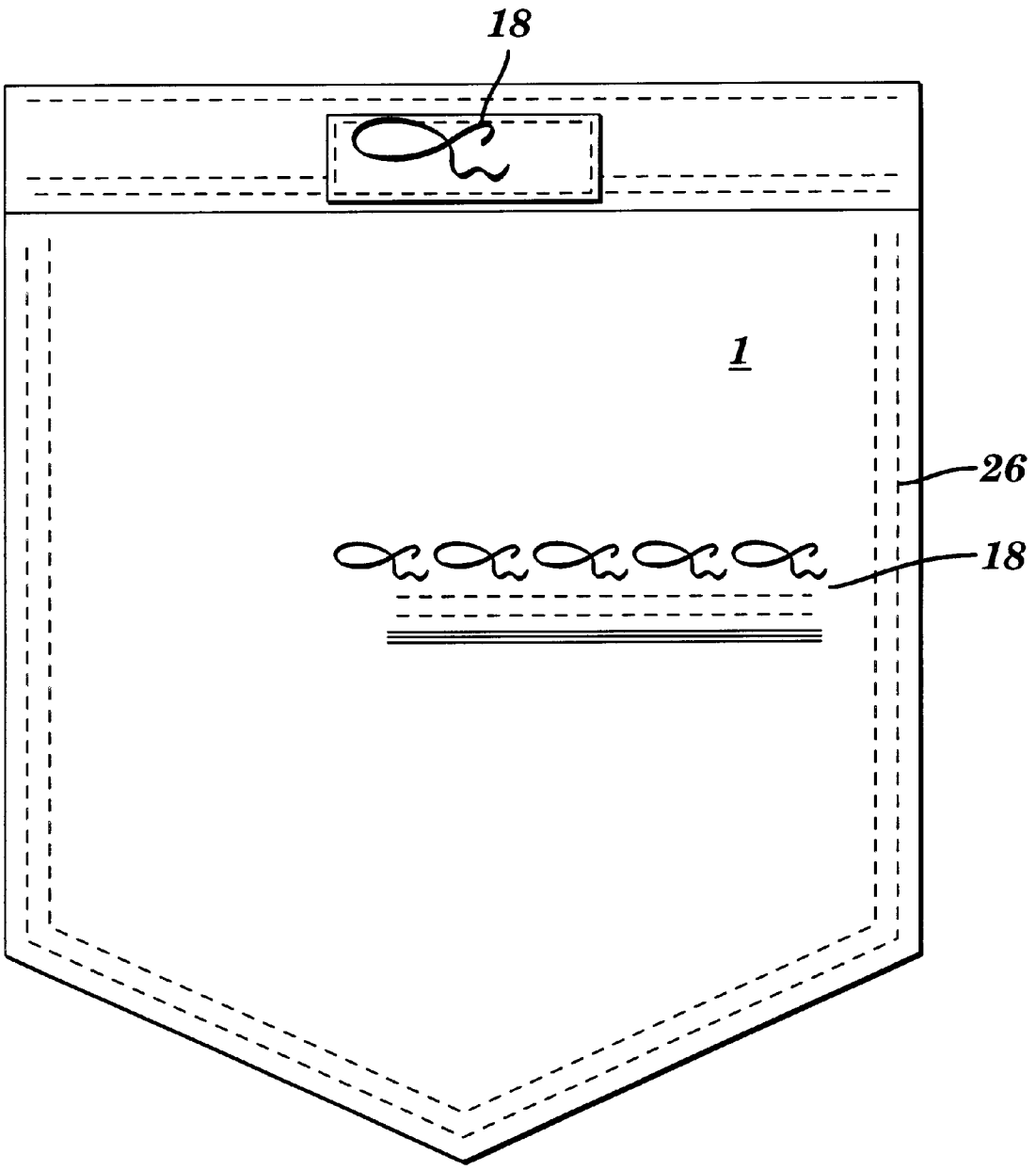
FIG. 1A is a front view illustrating the transfer pocket of a first embodiment of the invention.

The method for using the detachable, free-standing transfer pocket 1 (FIGS. 1A, 1B, 2, 2B, 3) is based on a hook and loop fastener, such as Velcro™ bonding of opposing surfaces 10 and 12 for temporary adhesion. For purpose of this disclosure, the fastener surfaces labeled as 10 will be referred to as loop fastener strips while those labeled as 12 will be referred to as hook fastener strips as these terms are commonly understood in the art. The hook and loop fastener strips 10 and 12 further include an adhesive on a back or non-mating surface of the strips 10, 12. In this example, the non-mating surface of the loop fastener strips 10 include an adhesive that adheres the loop fastener strips 10 to the transfer pocket 1. Likewise, the non-mating surface of the hook fastener strips 12 include an adhesive that adheres the hook fastener strips 12 to the attachment device 28, in this case, the lapel bar pins. It is understood throughout, however, that the hook and loop fastener strip surfaces can readily be interchanged such that loop fastener strip surfaces 10 comprise hooks while hook fastener strip surfaces 12 comprise loops, in any desired combination, within the scope of this invention and its associated claims. It is also understood that while this disclosure refers at times to and illustrates hook and loop fastener "strips," that in fact the fastener used in connection with this invention are more broadly defined as hook and loop fastener "pieces," including but not limited to strips, and can be cut into any suitable configuration consistent with the objects of the invention.

Transfer pocket 1 comprises a standard pocket with front and rear pocket surfaces defining a pocket interior therebetween. However, unlike a standard pocket, it is not in any way permanently stitched to a garment 22 (See FIG. 1B) such as, but not limited to clothing, a backpack or tote bag, luggage, etc.

Figure 2:
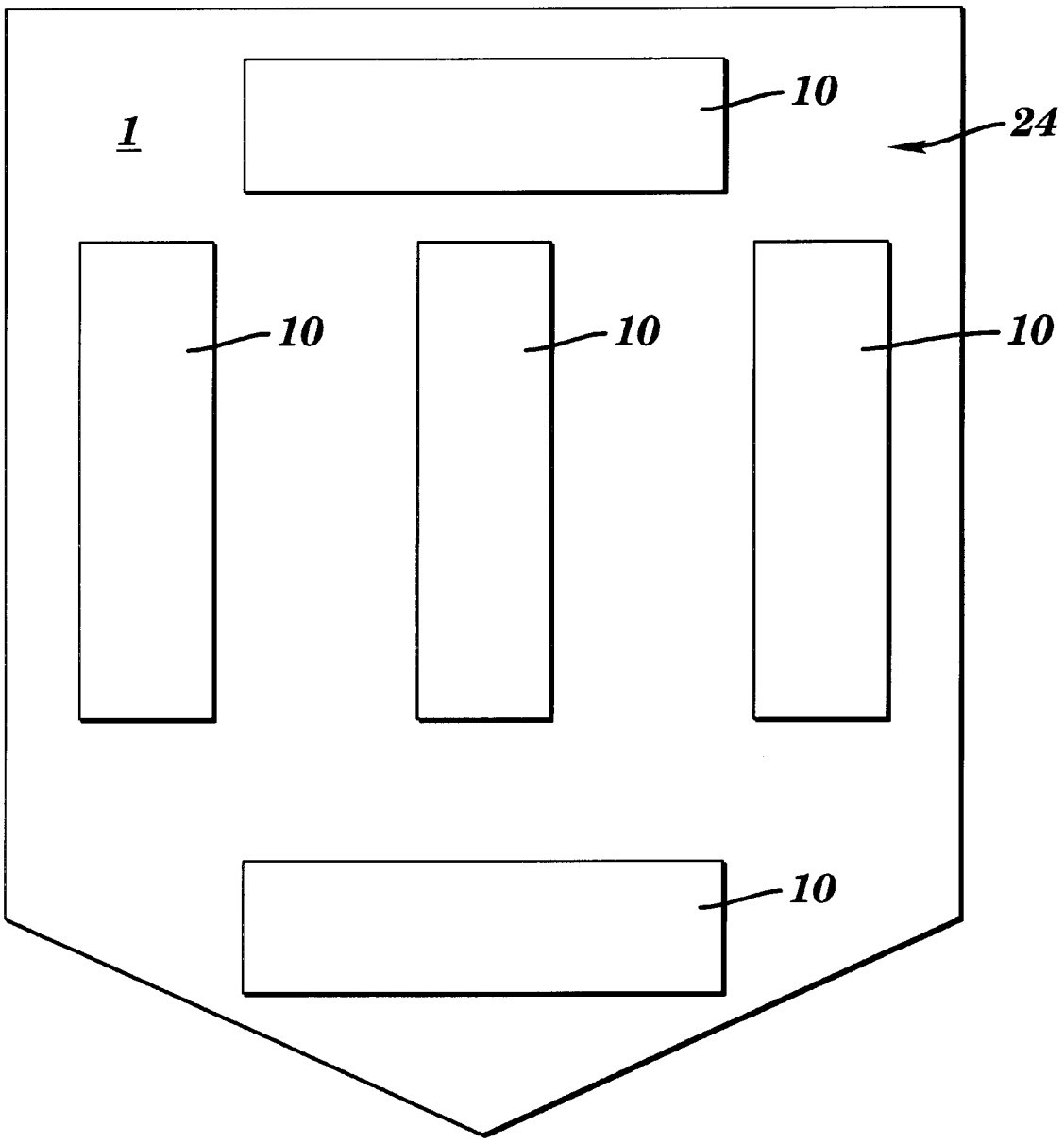
FIG. 2 is a rear view of the transfer pocket of the first embodiment of the invention.
Figure 2A:
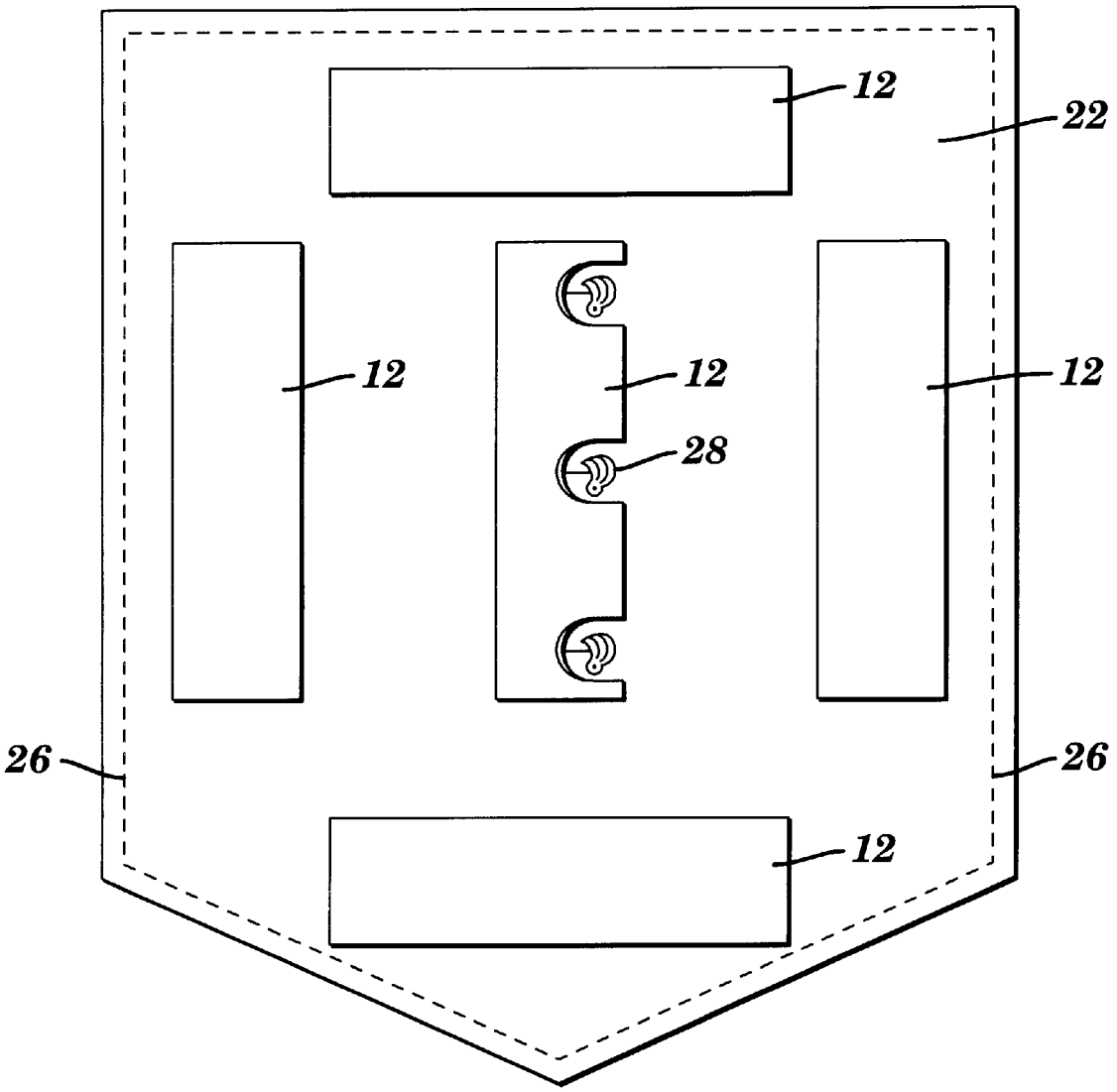
FIG. 2A is a front view illustrating fastener strips attached to a garment by pins, according to the first embodiment of the invention.
Figure 2B:
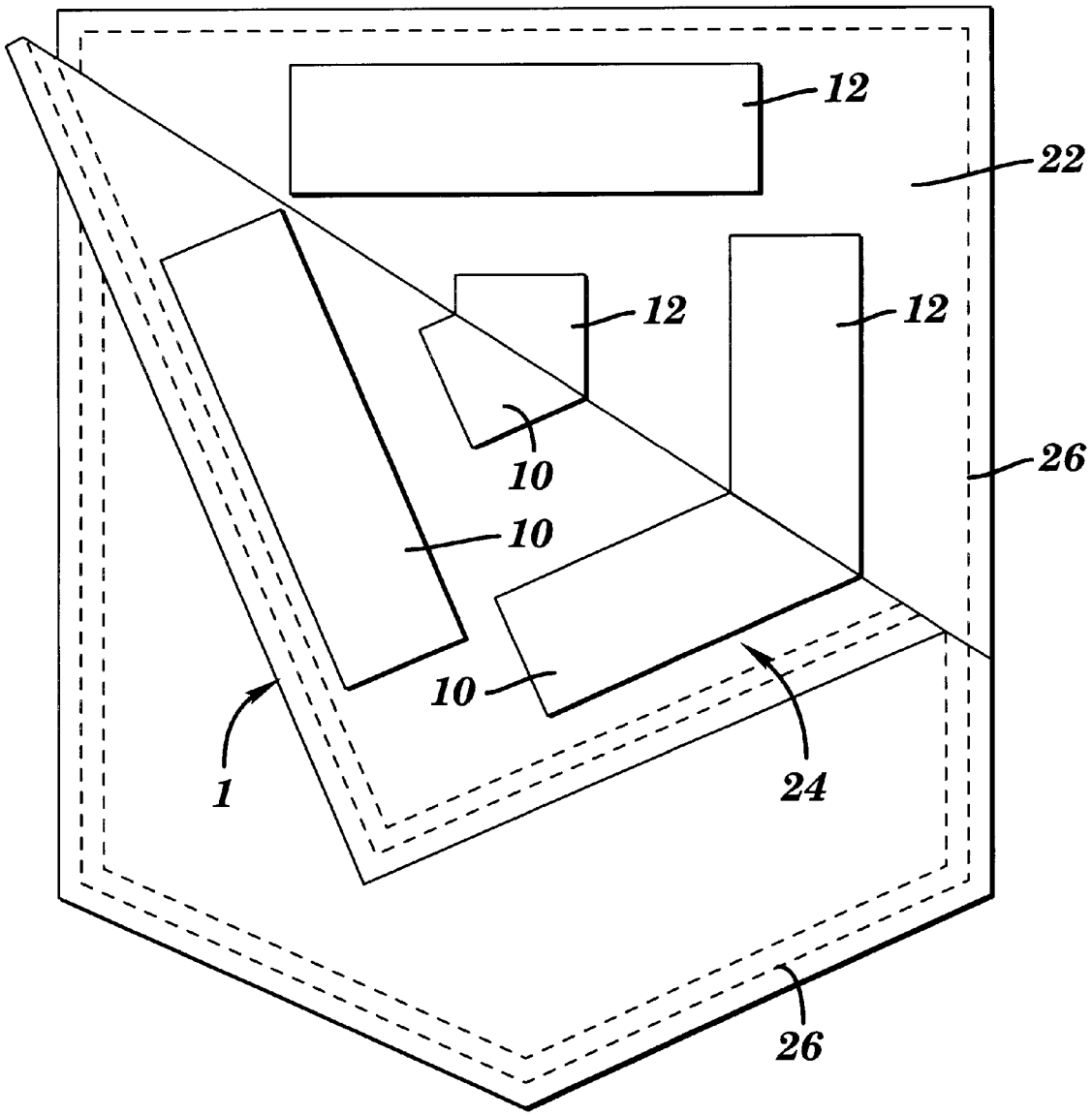
FIG. 2B is a front view of the garment with fastener strips receiving a transfer pocket, according to the first embodiment of the invention.
Figure 3:
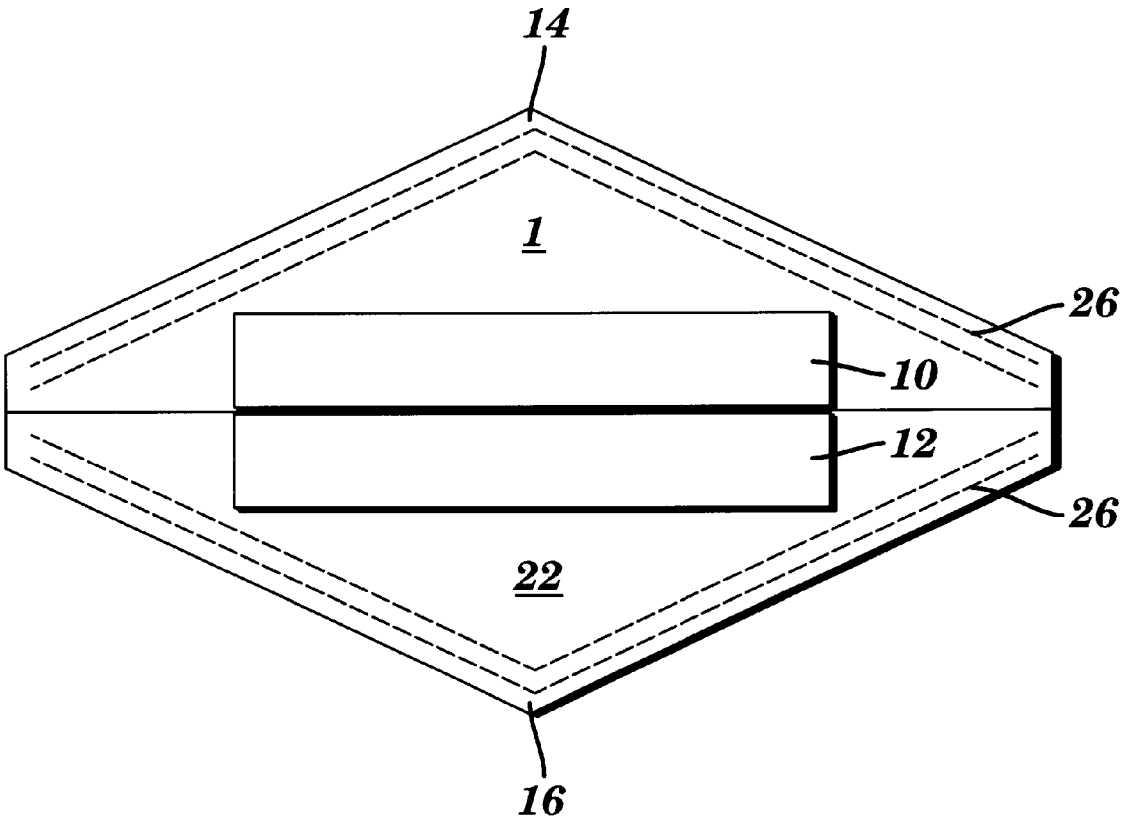
FIG. 3 illustrates the bottom corner of the transfer pocket, according to the first embodiment of the invention.
Figure 4:
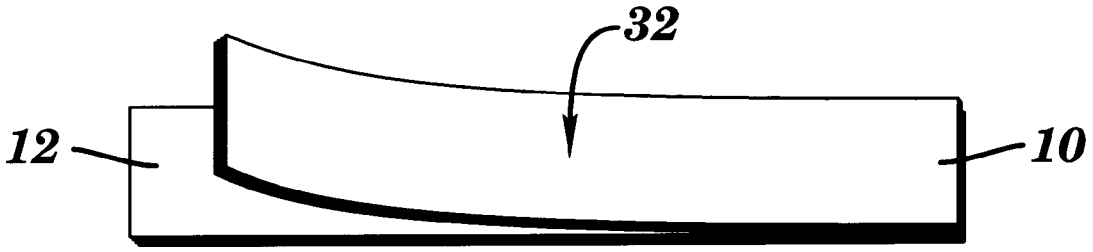
FIG. 4 shows a first fastener strip interlocking with a second fastener strip, as employed according to the first embodiment of the invention.

The transfer pocket 1 can be removably attached to one's garment 22 many times just by pressing opposing fastener strips 10 and 12 of hook and loop fastener together, as shown in FIGS. 2B, 3 and 4.

Figure 1B:
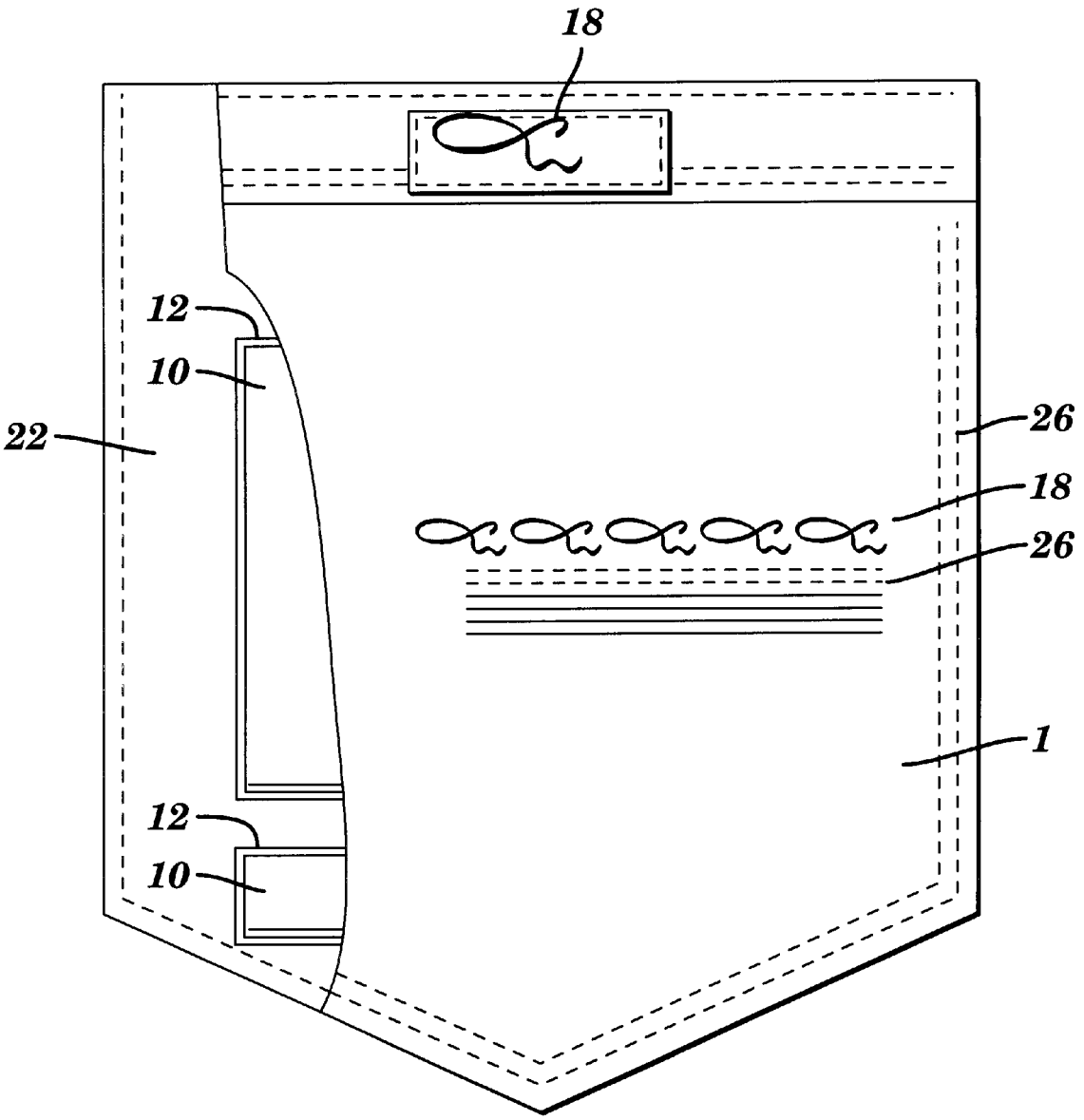
FIG. 1B is a front sectional view illustrating the transfer pocket and its means of attachment to an underlying garment pocket, according to the first embodiment of the invention.
Figure 4A:
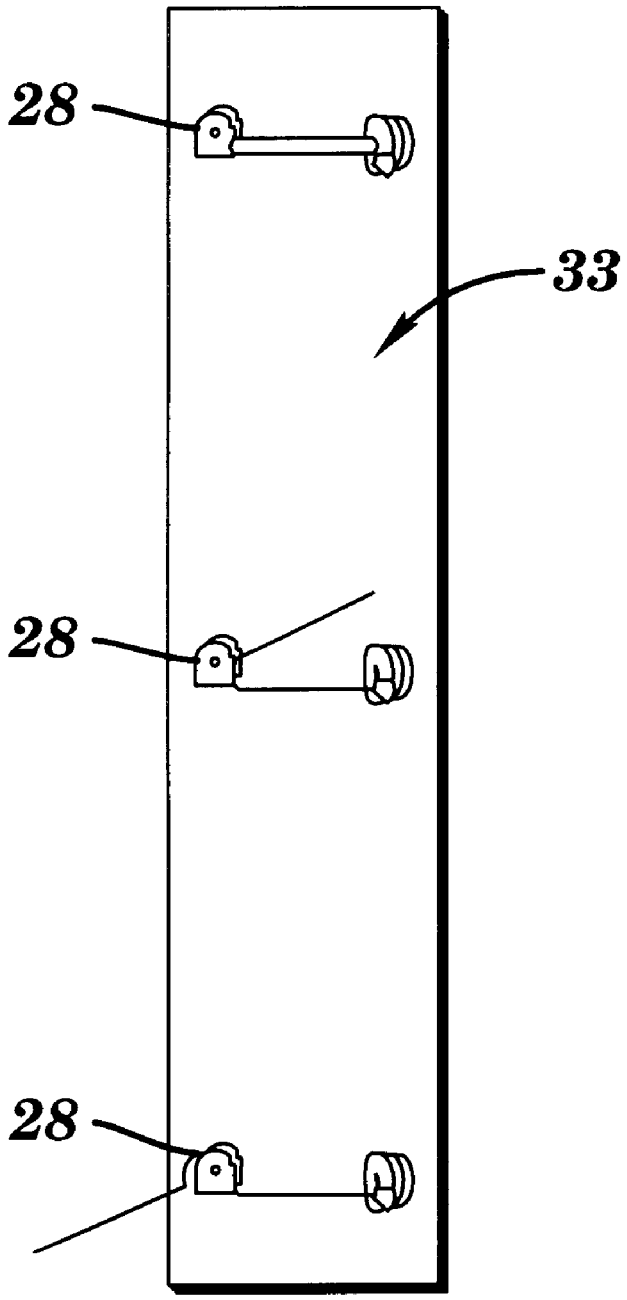
FIG. 4A shows the second fastener having pins affixed thereto, in three stages of operation, according to the first embodiment of the invention.

In order to use the transfer pocket 1 with preexisting garment 22 (see FIGS. 1B, 2B and 3), attachment device 28 such as pin fasteners, or locking lapel bar pins shown in FIGS. 2A and 4A are attached to the garment 22, particularly as shown in the cutaway view of center strip 12 in FIG. 2A as well as FIG. 4A. The locking lapel bar pins are preferred for use as the attachment device 28, since these are easily removed from garment 22 in case it is desired to revert to using garment 22 without this invention. These pins 28 are permanently attached onto the hook fastener strips 12, for example, by gluing, taping or similar process. The locking lapel bar pins 28 are beneath the hook fastener strips 12 adding much stability to the transfer pockets 1 firmly attaching the hook fastener strips 12 to garment 22 pocket or elsewhere on garment 22.

In alternative embodiments, attachment device 28 may be affixed to garment 22, for example, by sewing, ironing (with suitable heat-activated adhesive) or gluing; or by using buttons or snaps. Each of these alternative embodiments, however, is more permanent than the use of pins, and are not as readily removed if it is desired to revert to using garment 22 without this invention.

Attachment means 28 such as the illustrated pins are then placed through the preexisting garment 22 at a location where it is desired to attach transfer pocket 1, typically, but not limited to, a location directly over and upon a preexisting pocket (as shown in FIGS. 1B and 2B). The loop fastener strips 10, which mate with the hook fastener strips 12, may be permanently glued onto pockets.

An important benefit of this invention is to allow an infinite variety of pockets to be used in connection with any given garment 22. For example, FIG. 1A shows a monogrammed design 18 using a print transfer medium such as heat transfer or silk-screen which may be attached to the transfer pocket 1 a thread monogrammed design or embroidery 20. Slight variations in design may be used to achieve different looks. Of course, any design of any nature and any construction and origin can be used on transfer pocket 1 according to the invention, such that the pocket or pockets carried on a given garment 22 and the designs of those pockets 1, can be varied at will. Broken line surface stitching 26 functions also as part of both transfer pocket monogrammed designs 18 as well as thread which holds the transfer pockets 1 together 14.

FIG. 1B shows the alignment of the loop fastener strips 10 adhering to the transfer pocket 1, and the hook fastener strips 12 attached to the garment 22. FIG. 1B is cut away to show how the hook and loop fastener strips 10, 12 are interlocked during usage.

FIG. 2 shows typical placement of the loop fastener 10 strips with the adhesive side of these strips affixed to the back surface 24 of the transfer pocket 1 of FIGS. 1A, 1B. This illustration shows the loop fastener strips 10 completely positioned and ready to be interlocked with the matching hook fastener strips 12 attached to the garment 22, FIG. 2A.

FIG. 2A shows the pocket of garment 22 with hook fastener strips 12 and cut away section of middle hook fastener strip 12 exposing underlying lapel bar pins 28 that have entered through the fabric of garment 22 and are now locked into position and ready to receive transfer pocket 1. Hook fastener strips 12 further include attachment device 28 such as the illustrated lapel bar pins which are permanently affixed to the hook fastener strips 12 as noted earlier.

FIG. 2B shows the pocket of garment 22 in complete alignment with transfer pocket 1, which has been placed over the pocket of garment 22 and pulled back in this illustration to demonstrate a typical alignment of complementary hook and loop fastener strips 10 and 12.

FIG. 3 is another view of the placement and alignment of complementary hook and loop fastener strips 10, 12 showing how both transfer pocket 1 and the pocket of garment pocket 22 are in complete alignment and ready to have the loop fastener strip 10 of the transfer pocket 1 bottom comers 14, interlock with the hook fastener strip 12 of the sewn garment pocket 22 bottom comers 16. Then, after securing and locking together both the transfer pocket 1 and the pocket of garment 22, the transfer pocket 1 is ready for usage.

FIG. 4 shows the two complementary hook and loop fastener strips 10, 12 with the top loop fastener strip 10 lifted slightly upward to demonstrate how both strips 10, 12 are placed together during usage. Adhesive surface 32 of the loop fastener strip 10 is on the very top layer that is closest to one viewing the illustration. Adhesive surface 33 of the hook fastener strip 12 is on the underside of the hook fastener strip 12 and farthest point away from viewers eye, as seen more clearly in FIG. 4A. The brush of the loop fastener strip 10 is facing downward in this illustration and the grid of the hook fastener strip 12 is facing upward in this illustration and is directly below the loop fastener strip 10 and is partially interlocked with loop fastener strip 10.

FIG. 4A shows attachment device 28 comprising locking lapel bar pins 28 that are permanently glued to the hook fastener strips 12 for usage on clothing or other objects constructed of fabric. These locking pins 28 are shown in three different stages of operation. The first (top) pin 28 is closed and locked. The second (middle) pin 28 is slightly open and almost ready for usage. The third (bottom) pin 28 is fully extended and completely ready to lock the hook fastener strip 12 to garment 22.

It is understood that while a particular configuration of hook and loop fastener strips is illustrated herein (e.g., FIGS. 2 and 2*a*), that this is for exemplary purposes only, and that any configuration of complementary hook and loop fastener pieces that serve to securely attach transfer pocket 1 to garment 22 is considered within the scope of this disclosure and its associated claims.

There are a number of advantages that are achieved by virtue of the detachable transfer pocket 1 described and illustrated above, as follows:

Versatility—by contrast to the traditional sewn on pocket, transfer pocket 1 has the advantage of detachment from garments to placement on car dash, table, etc., to be filled with items and reattached to one's garment. Anywhere extra hook fastener strip 12 are attached, a transfer pocket 1 can be placed. A waterproof variety of pocket would accommodate wet soda cans while traveling.

Multiple Usage—transfer pocket 1 can be utilized in a variety of situations eradicating that tight pull of the traditional sewn on pocket by virtue of the fact that it attaches onto a pre-existing traditional sewn on pocket so advantageously. Further, the transfer pocket creates pockets 1 where none exist (on shirts, slacks, jeans, jackets, athletic gear, athletic bags, totes, golf bags, beachwear, baby carriages, furniture, computers, even appliances, and as a small appliance holder for mini microphones, phones, pagers and radios). Again, one can transfer the transfer pocket 1 from clothes onto a multitude of surfaces and back again onto one's garment (for example, as a garment to tennis tote transfer). Lapel bar pins 28 add leverage to pocket extending across hook fastener strip 12 and are easily opened and closed, and locked even while being worn. These safety lock pins 28 are non-pulling to hook fastener strips 12 and garment 22 as well. These pins 28 create a very secure bond of the hook fastener strips 12 to the pocket with loop fastener strips 10.

Evolving, multiple appearances and designs - unlike the traditional sewn on fixed pocket, detachable transfer pocket 1 can be designed with a vast array of prints, originally titled and untitled artwork, embroidery, photography, and virtually any other design that can fit on a pocket. This provides infinitely greater variability over a regular, traditional sewn on pocket by creating a multitude of very personalized looks from a single garment that can be changed instantaneously recreating one's look daily from that same garment. For example, one can use a first pocket for a "day look," and a second for an "evening look." Unlike the traditional sewn on pocket one can "design" his or her own look having more visual appeal than the traditional pocket. A variety of materials and designs of this invention can be of like materials and colors as, or in contrast to, one's underlying outfit.

Promotions—transfer pocket 1 can be used as a promotional pocket for individuals or corporations to promote their signed art or own products, to promote sports stars and/or celebrities, or signed or unsigned reprinted art and/or photography, for example.

Repair—transfer pocket 1 is a quick repair pocket. Unlike the traditional sewn on pocket, this pocket is able to instantly function as a patch for suddenly discovered tears on one's garment and hence a stylish cover-up with utility, especially on an otherwise torn, unserviceable pocket. It can also recreate a pocket by attaching a plain but originally designed pocket or a printed pocket over a sewn on damaged pocket.

Fashion trends—transfer pocket 1 coincides well with today's temporary trends, temporary tattoos, temporary facial stickers, temporary body paints and pencils and the movement to decorate oneself temporarily in an arts and crafts manner.

Extra pocket space—transfer pocket 1 solves the problem of having so many things to transport and not enough pockets to accommodate the individual's personal items. One simply attaches an additional transfer pocket 1 at a desired location on one's garment 22.

Extra luggage space—if one needs extra luggage space but does not wish to carry an extra tote, larger sized version of transfer pocket 1 can be attached to the luggage, backpacks, tote bags, etc.

Arthritis and movement disabilities—pocket 1 provides a place to put magnets into for arthritic areas on one's body using additional hook and loop fastener strips across the top of the transfer pocket 1 having the advantage of continual pain relief, inconspicuously, while using a colorful or plain but originally designed transfer pocket 1. Arthritics would additionally benefit from usage of this transfer pocket 1 as it would aid them and all those lacking dexterity by not having to reach around to use it, and unlike the typical sewn on pocket can be placed where most comfortable and convenient to use allowing one to fill and reattach anywhere. Similarly, less ambulatory individuals such as hospitalized people could utilize this pocket 1 on their attire as well as on their beds, walkers, wheel chairs, canes, etc.

Athletic usage—athletes such as runners, weight lifters, tennis and racquetball players would benefit from usage of this transfer pocket 1 particularly enabling them to have a carrier for water bottles, balls, head sets, watches, rings, etc.

Transfer pocket 1 offers limitless usage both personal and occupational with so many mix and match combinations giving new enlightenment to the word pocket. Furthermore, the additional advantages of this pocket are as follows:

The consumer can choose the amount of pocket adhesion by personally selecting the number and size of hook and loop fastener strips 10, 12 appropriate for the weight the pocket will carry.

Transfer pocket 1 provides greater flexibility than a sewn on pocket by offering the ability to control how close or far from the body an individual prefers to wear it, either very open using less hook and loop fastener strips 10, 12 or much more flat and streamlined closer to the body using more hook and loop fastener strips 10, 12. Consequently the more opened pocket would accommodate such things as soda cans or tennis balls, and more rounded items such as small repair tools and garden tools.

Transfer pocket 1 doesn't constrict usage of a sewn on pocket when placed over it, rather it conforms to the shape of the sewn on pocket or wherever it is placed it conforms to the shape it is placed upon due to the flexibility of the hook and loop fastener strips 10, 12.

Transfer pocket 1 eliminates the need for persons using a microphone to strap one's mini microphone to one's waist which repeatedly fall off. Transfer pockets 1 in this instance can be manufactured plain and in a variety of materials to match one's outfit, yet of original design or accompanied with original reprinted art, photography, or embroidery.

Transfer pocket 1 enables size variation from small to large. The transfer pocket 1 may be attached inside of a garment 22 pocket with a torn inner lining, thus replacing the original inner pocket lining, in an inconspicuous manner not visible from outside.

Similarly, transfer pocket 1 may be used to secure items inside one's blazer, dress, etc., maintaining a smooth pocket free look of one's garment, for example, as a carrier for mini microphones, radios, pagers, etc. Again, transfer pocket 1 in this method of use is attached via pins 28 inside garment 22 (in a non-externally-visible region).

Transfer pocket 1 increases the longevity of one's sewn on pocket and increases the longevity of the entire garment with sewn on pockets by taking extra pressure of one's usually filled sewn pocket, and hence, causing less wear and tear one's garment 22 in the entire sewn on pocket area.

Transfer pocket 1 can be used as a therapeutic body contact device carrier, such as to hold an ice pack or a heat pad icing or heating wherever an injury may occur and for travel to one's destination all the while, being able to continually ice one's injury nearly anywhere on one's body freeing hands to drive or walk and allowing one to keep icing or heating their injury while in motion. Closing the top of pocket with additional hook and loop fastener strips allows one to ice or heat an injury unknowingly to others viewing the transfer pocket. Here, pocket 1 is attached to garment 22 proximate the body region to be iced or heated.

Transfer pocket 1 allows the user to detach and reattach the pocket to enable better viewing of items in the pocket as desired.

Transfer pocket 1 parallels today's trends, having the capacity to function beyond the confines of just an ordinary sewn on pocket turning into the equivalent of an instant stick on decal or patch cover-up.

Figure 5:
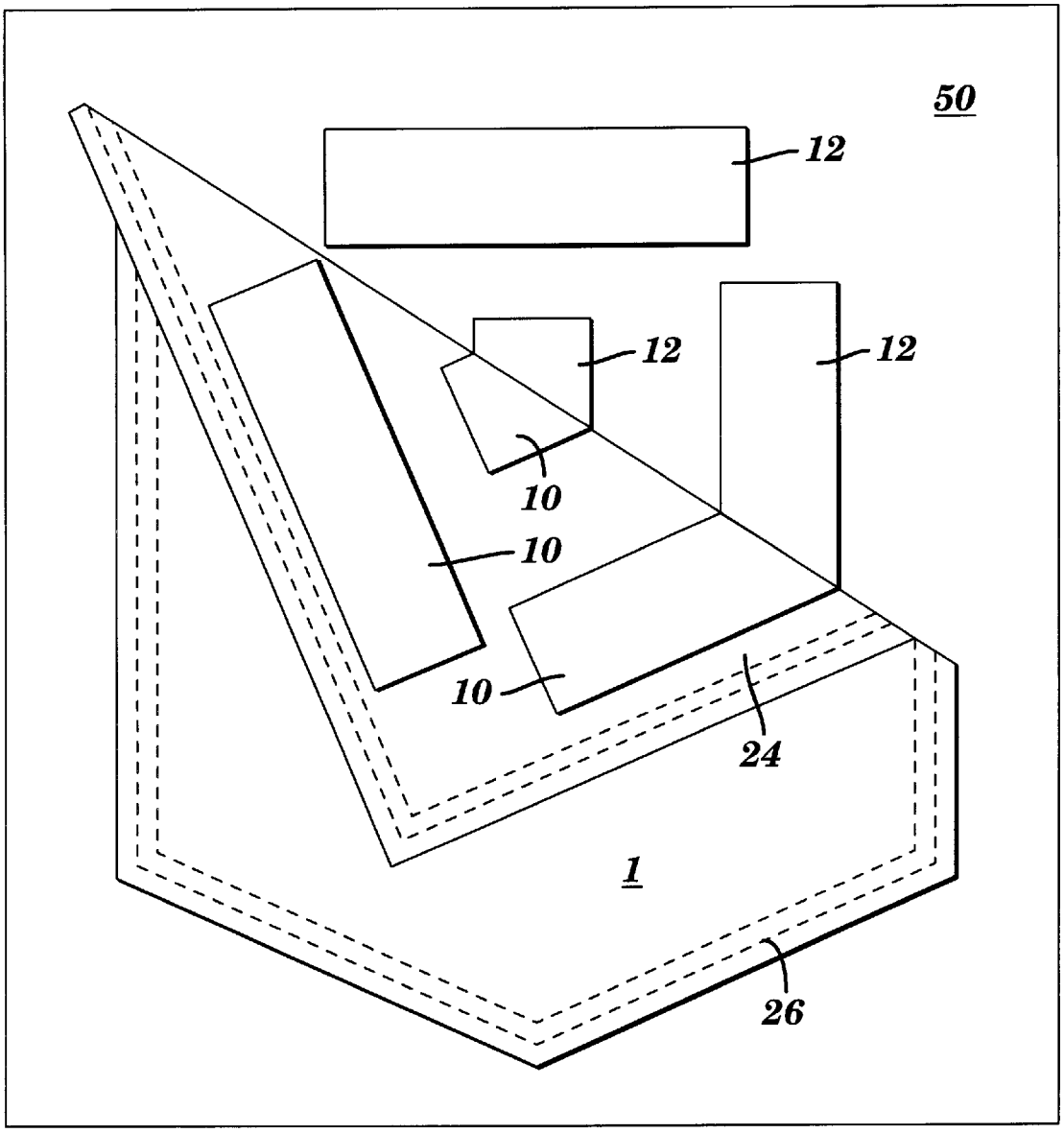
FIG. 5 is a front view showing the transfer pocket attached to a non-garment surface.

Transfer pocket 1 will offer users unlimited original looks from one single ensemble. It can also be wall mounted, chair mounted, etc. after wearing the transfer pocket 1, transforming into part of one's decor. In this situation, a first hook and loop fastener strip 12 is attached to the wall, chair, etc., which in this embodiment serves the role of a mounting surface 50, as illustrated in FIG. 5.

Transfer pocket 1, if signed and created by a celebrity, would then become a collectable piece of art. For example, if celebrities, sports stars and musicians were to use this invention by endorsing their own creative photography and/or signed art, this invention would transform into special edition collectable pockets, to collect and trade and mount on one's wall.

These pockets used in this manner would also encompass topics like basketball, baseball, football, tennis or even antique cars turning into pictorials, like trading cards, signed game cards to mix and match and trade with one's friends, etc.

Consequently, this invention will enhance one's imagination and creativity wearing the invention one day on apparel and then personalizing one's decor the next day by mounting invention on wall, chair, desk, bed, etc. Extra matching sets of hook fastener strips 12 without glue, locking lapel bar pins 28 could be purchased for usage on non-garment surfaces 50 (see FIG. 5) such as walls, furniture, beds, appliances, objects mad of wood or metal, such as lockers, etc. Loop fastener strips 10 to be used in the above manner remain on these objects to ensure strong adhesion which can be made more permanent by usage of nails, glue, staples, hooks, or wiping isopropyl alcohol over surface where loop fastener strips 10 will then be attached.

Furthermore, original transfer pockets 1 having reprinted art, photography and embroidery, signed or not, titled or not, are then rotated and interlocked with this opposing, mating fastener strips 10, 12.

Games can be created with this transfer pocket 1 by detaching and reattaching to one's body or wherever, functioning as dice holders, marble holders, card holders, puzzle holders, miniature toy holders. For example, one may even use the transfer pockets 1 for games involving concentration matching the design on front of pocket to what's hidden inside the transfer pocket 1.

The invention could also be used as a mini tool repair holder to transfer from garments to one's repair area placing onto wall or chair, etc., to be repaired.

Manufacturers of heat transferable printing will benefit from this invention as their printed material appearing on the transfer pocket 1 would be subjected to less harsh machine laundering by virtue of the distinct advantage of removing the transfer pocket 1 prior to wash, increasing the longevity of their printed designs and saving the consumer by making one's purchases last longer enabling consumer to launder gently and at will.

Hook and loop fastener strips that are permanently attached are also subjected to harsh laundering which then frays, ruining the look of garment attached thereto, whereas the hook fastener strips 12 are advantageously removed prior to wash, once again saving the consumer.

In short, transfer pocket 1 with hook and loop fastener strips 10, 12 is easy, convenient and advantageous to use, enhancing one's garments with original designs and having an element of fun for all ages.

The transfer pocket 1 coincides with mobility of today's society from attachment to one's computer, to slacks, to classroom or workplace.

The above description indicates to reader the many embodiments the invention contains yet assuredly the scope of this invention is far more expansive.

Consequently, the true essence or scope of this invention should be determined by the claims which follow and their legal equivalents as opposed to the aforementioned examples.

While only certain features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A removable pocket, comprising:

the pocket having at least one first hook and loop fastener device attached thereto;

at least one second hook and loop fastener device having at least one lapel bar pin fixedly mounted to a non-mating surface of the at least one second hook and loop fastener device, wherein mating surfaces of the first and second hook and loop fastener devices removably adhere the first and second hook and loop fastener devices to one another, and wherein the lapel bar pin fastener removably attaches the second hook and loop fastener device to a complementary wearing apparel.

2. The removable pocket of claim 1, wherein the pocket comprises a decorative fabric.

3. The removable pocket of claim 1, wherein the removable pocket further comprises a decorative design.

4. The removable pocket of claim 1, wherein the first hook and loop fastener device is attached to the pocket using a fastener selected from the group consisting of: glue, nails, staples, hooks, and thread.

5. The removable pocket of claim 1, wherein the lapel bar pin fastener is glued to the second hook and loop fastener device.

6. A method of removably attaching a transfer pocket to a garment, comprising:

affixing a first hook and loop fastener device to a surface of the transfer pocket;

providing a second hook and loop fastener device, having a mating and a non-mating surface;

permanently mounting a lapel bar pin to the non-mating surface of the second hook and loop fastener device;

pinning the second hook and loop fastener device to the garment; and mating the first and second hook and loop fastener devices.

* * * * *